US007097162B2

(12) United States Patent
Ichihara et al.

(10) Patent No.: US 7,097,162 B2
(45) Date of Patent: Aug. 29, 2006

(54) CARBURETOR WITH FUEL VAPOR CONTROL

(75) Inventors: Tadaatsu Ichihara, Kakuda (JP); Takeshi Sakaguchi, Natori (JP)

(73) Assignee: Walbro Japan, Inc., Tokyo (JP)

( * ) Notice: Subject to any disclaimer, the term of this patent is extended or adjusted under 35 U.S.C. 154(b) by 193 days.

(21) Appl. No.: 10/810,984

(22) Filed: Mar. 26, 2004

(65) Prior Publication Data

US 2004/0232568 A1 Nov. 25, 2004

(30) Foreign Application Priority Data

Mar. 26, 2003 (JP) ..... 2003-085144

(51) Int. Cl.
*F02M 19/06* (2006.01)

(52) U.S. Cl. ..... 261/35; 261/DIG. 25; 261/DIG. 55; 261/DIG. 83

(58) Field of Classification Search ..... 261/35, 261/69.1, 69.2, DIG. 25, DIG. 55, DIG. 68, 261/DIG. 81, DIG. 83; 123/516
See application file for complete search history.

(56) References Cited

U.S. PATENT DOCUMENTS 4,455,266 A * 6/1984 Gerhardy ..... 261/35
4,563,311 A * 1/1986 Agnew ..... 261/35
4,949,692 A * 8/1990 Devine ..... 123/687
5,002,705 A * 3/1991 Kohler ..... 261/35
5,599,484 A * 2/1997 Tobinai ..... 261/44.2
6,202,988 B1 * 3/2001 Abe et al. ..... 261/34.1
6,374,810 B1 4/2002 Pattullo ..... 123/516
6,425,573 B1 * 7/2002 Suzuki ..... 261/35
6,439,546 B1 8/2002 Galka ..... 261/4
6,644,631 B1 11/2003 Suzuki ..... 261/35
6,820,864 B1 * 11/2004 Amou et al. ..... 261/78.1
2001/0035168 A1 * 11/2001 Meyer et al. ..... 123/520

FOREIGN PATENT DOCUMENTS

JP 4-339161 * 11/1992 ..... 261/DIG. 68

* cited by examiner

*Primary Examiner*—Richard L. Chiesa
(74) *Attorney, Agent, or Firm*—Reising, Ethington, Barnes, Kisselle, P.C.

(57) ABSTRACT

A carburetor includes a body having a fuel and air mixing passage formed therein and an opening in fluid communication with the fuel and air mixing passage, a fuel metering assembly carried by the body and including a fuel metering diaphragm that defines at least part of a fuel chamber that is communicated with the opening, and a groove formed in the body and open to the fuel chamber. The groove communicates at one end with the opening so that fuel vapor in the groove can be moved from the fuel chamber to the fuel and air mixing passage via the groove and opening. The groove is preferably provided at least in part in a peripheral portion of the fuel chamber to guide vapor to a fuel jet as the fuel vapor moves within the fuel chamber.

17 Claims, 1 Drawing Sheet

CARBURETOR WITH FUEL VAPOR CONTROL

REFERENCE TO RELATED APPLICATION

Applicants claim priority of Japanese Application Ser. No. 2003-085144, filed on Mar. 26, 2003.

FIELD OF THE INVENTION

The present invention relates generally to a carburetor and more particularly to a carburetor with improved control of fuel vapor.

BACKGROUND OF THE INVENTION

Conventional diaphragm-type carburetors with a diaphragm fuel pump can produce increased vibration in a fuel metering chamber of the carburetor. This, along with engine vibration of the carburetor, and the heat transferred to the fuel in the carburetor, tends to generate increased fuel vapor in the fuel metering chamber. If the vapor is not removed satisfactorily it can block or severely restrict fuel flow through a fuel jet to bring forth a so-called vapor lock state, wherein the supply of fuel to the engine is at least temporarily interrupted resulting in unsteady engine operation or an engine stall. Japanese Patent Publication No. 28341/1968 and Japanese patent Laid-Open No. 131807/1998 disclose techniques to alleviate this problem. However, vapor lock is still possible under severe engine load conditions.

SUMMARY OF THE INVENTION

A carburetor includes a body having a fuel and air mixing passage formed therein and an opening in fluid communication with the fuel and air mixing passage, a fuel metering assembly carried by the body and including a fuel metering diaphragm that defines at least part of a fuel chamber that is communicated with the opening, and a groove formed in the body and open to the fuel chamber. The groove is communicated at one end with the opening so that fluid in the groove can be moved from the fuel chamber to the fuel and air mixing passage via the groove and opening. The groove is preferably provided at least in part in a peripheral portion of the fuel chamber to guide vapor to a fuel jet as the fuel vapor moves within the fuel chamber. Desirably, the vapor generated in the fuel chamber is caught by an edge of the groove, guided and forced into the groove, and taken in and discharged into the fuel and air mixing passage. This prevents a large quantity or volume of fuel vapor from collecting in the fuel chamber to reduce the likelihood of and preferably prevent vapor lock or undesirable engine performance caused by intermittent overly lean fuel.

Some potential objects, features and advantages of the invention include providing a carburetor that reduces the volume of fuel vapor permitted to collect in the fuel chamber of a carburetor, controls the rate of fuel vapor delivery to the engine, reduces the instantaneous quantity of fuel vapor discharged from a carburetor, improves fuel vapor removal from a carburetor, improves the running performance of an engine, provides a more consistent fuel and air mixture from a carburetor for delivery to an engine, reduces or eliminates vapor lock, improves engine stability, reduces overall exhaust emissions, provides more stable exhaust gas emissions, is of relatively simple design and economical manufacture and assembly, and is rugged, durable and has a long in-service life.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF THE PREFERRED EMBODIMENTS

Figure 1:
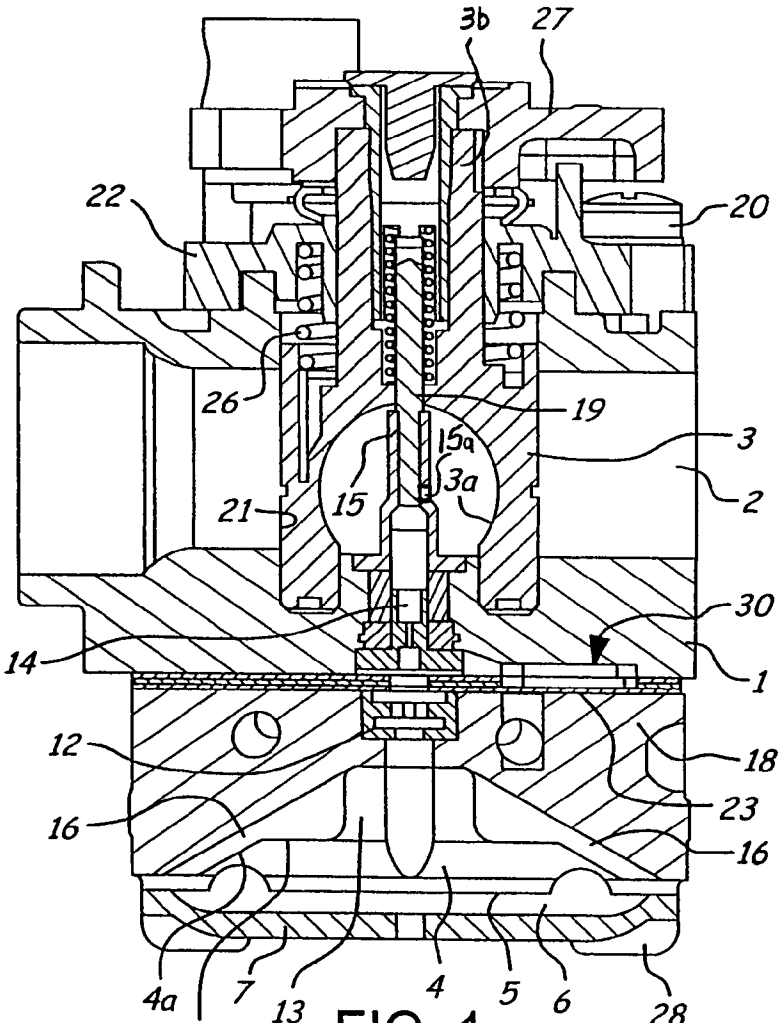
FIG. 1 is a full sectional view showing a fuel supply mechanism of a diaphragm-type carburetor according to one embodiment of the present invention.

Referring in more detail to the drawings, FIG. 1 illustrates a carburetor having a main body 1 through which a fuel and air mixing passage 2 extends laterally, and a throttle valve 3 having a throttle bore 3*a* is rotatably and vertically movably fitted into a cylindrical valve chamber 21 that is perpendicular to the fuel and air mixing passage 2. A lid plate 22 closes an upper end of the valve chamber 21 and is coupled to the carburetor main body 1 by a plurality of bolts 20. A small diameter valve stem 3*b* is formed on the upper end of the throttle valve 3 extends through the lid plate 22, and a throttle valve lever 27 is coupled to the upper end of the valve stem. An arcuate cam groove formed on the lower surface of the throttle valve lever 27 and a follower projecting from the lid plate 22 constitute a cam mechanism for axially moving the throttle valve as it is rotated. To yieldably bias the throttle valve 3 toward its idle position, a return spring 26 is interposed between the lid plate 27 and the throttle valve 3.

When the throttle valve 3 is rotated from its idle position toward its wide open position, the throttle bore 3*a* becomes increasingly aligned with the fuel and air mixing passage 2. At the same time, the throttle valve 3 and a needle 19 carried by the throttle valve are lifted up by the cam mechanism to increase the degree of opening of an orifice 15*a* of a fuel nozzle 15 through which liquid fuel flows. The fuel nozzle 15 extends into the throttle bore 3*a* and is supported adjacent its lower end on the carburetor main body 1. A check valve 12 and a fuel jet 14 are disposed in a passage which leads from the fuel chamber 4 to the fuel nozzle 15.

A fuel supply pump 30 includes a fuel pump diaphragm 23 disposed between the carburetor main body 1 and a pump body 18. The diaphragm 23 defines at least part of a pulsation pressure chamber on one side and a pump fuel chamber on the other side. A cover plate 7 is attached by a plurality of bolts 28 to the lower surface of the pump body 18 with a fuel metering diaphragm 5 therebetween. The fuel metering diaphragm 5 defines at least part of a fuel metering chamber 4 on one side and an atmospheric chamber 6 on its other side.

Figure 2:
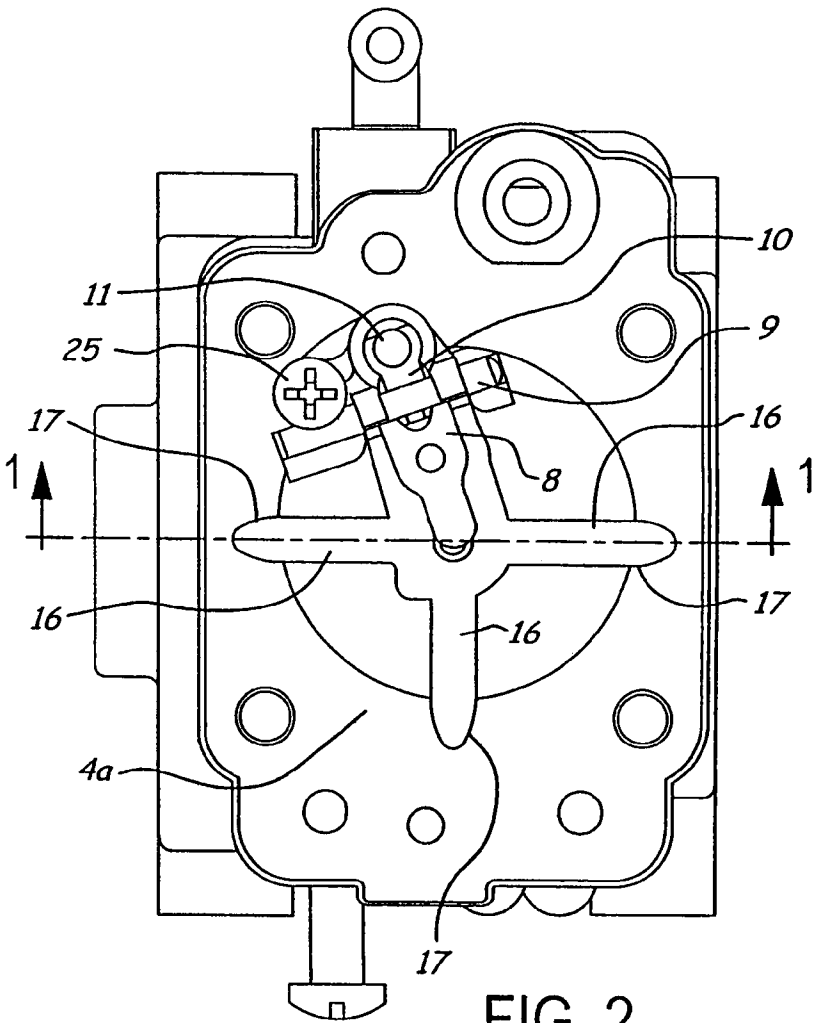
FIG. 2 is a bottom view of the carburetor body showing a fuel metering valve assembly incorporated into a fuel chamber of the carburetor.

As shown in FIG. 2, a lever 8 is pivotally supported on a rod or pin 9 retained by a bolt 25 on an upper wall 4*b* of the fuel chamber 4. One end of the lever 8 is normally in contact with a center portion of a diaphragm 5 while the other end 10 is engaged with a lower end of a fuel control needle valve 11 which is yieldably biased toward its closed position by the force of a spring. When the fuel metering diaphragm 5 is displaced downward or upward according to an increase or decrease in the quantity of fuel in the fuel chamber 4, the lever 8 is tilted or pivoted to close or open the fuel control needle valve 11 to maintain the fuel quantity in the fuel chamber 4 at a generally fixed level.

The fuel chamber 4 comprises a recess or cavity in the body 1 that has a generally flat upper wall 4*b* and a frusto conical or narrowing sidewall 4*a* which has a diameter that decreases toward its upper end. A communicating opening or recess 13 extending toward a check valve 12 is formed substantially in the center of the upper wall 4*b*.

In one presently preferred embodiment of the carburetor, at least one vapor groove 16 is provided in the main body 1 extending generally to about the periphery of the fuel chamber 4, and each vapor groove 16 is communicated with an opening 13 in communication with the fuel jet 14. In the embodiment shown, three grooves 16 are provided, each extending outwardly from the opening 13 and have free ends that are spaced apart by about 90 degrees. In one presently preferred embodiment the grooves 16 extend generally radially from the opening 13 and are circumferentially spaced from each other. Of course, the number and orientation of the grooves 16 can be modified as desired for a particular application. The grooves 16 preferably have a free or outward end 17 that extends beyond the periphery of the cavity in the body 1 that defines part of the fuel chamber 4. The vapor grooves 16 are preferably inclined upwardly from the lower end of the pump body 18 toward the upper end of the communicating opening 13. The depth of each groove 16 is preferably generally the same or constant in the conical wall 4*a*, but is preferably not the same between the upper wall 4*b* and the communicating opening 13. Rather, each groove 16 preferably becomes deeper as the groove 16 extends from the conical wall 4*a* to the opening 13. Each groove 16 is preferably open along its length to the fuel chamber 4.

When the fuel pump diaphragm 23 is displaced by a pulsating pressure signal, for example, from a crank chamber of the engine, fuel in a fuel tank (not shown) is taken into the pump chamber, and is supplied to the fuel chamber 4 from the pump chamber through the fuel control needle valve 11 (only the lower end of the valve is shown). When the vapor generated in the vicinity of the peripheral wall portion (conical wall 4*a*) of the fuel chamber 4 moves around the peripheral wall portion, the vapor collides with or flows into the grooves 16, and may initially encounter the grooves in the area of the outward ends 17 of the grooves 16. The vapor in the grooves 16 is guided to the opening 13 communicating with the fuel jet 14 and is quickly discharged together with fuel into the fuel and air mixing passage 2 via the check valve 12, the fuel jet 14, and the fuel orifice 15*a* of the fuel nozzle 15.

Moreover, since the ends 17 of the grooves are disposed on or near the peripheral wall portion of the fuel chamber 4, the vapor collides with the ends 17 and grooves 16 before it can grow, accumulate or significantly collect in one location, and is quickly taken in and discharged to the fuel and air mixing passage 2 via the opening 13 and the fuel jet 14. Further, the growth of fuel vapor bubbles can be controlled or limited by determining a position or orientation of the ends 17, that is, the start end of the grooves 16, and the position of the ends 17 may be determined in view of the ability to form or ease of formation of the grooves 16. This prevents a large volume of fuel vapor from collecting in the fuel chamber 4 and being delivered at once to the engine which would result in an at least temporarily lean fuel mixture delivered to the engine and subsequent unsteady engine operation.

Accordingly, when fuel vapor is generated it is caught by or flows into the vapor groove or grooves 16 sequentially and efficiently and is guided to the communicating opening 13. The rate at which fuel vapor is discharged from the carburetor fuel metering chamber is more consistent, and can be controlled by design. Because of this, the growth or collection of vapor in the fuel chamber is suppressed, the chance of vapor lock is reduced or eliminated, and stable engine operation and reduced and stable exhaust gas emissions are obtained.

The invention claimed is:

1. A carburetor, comprising:

a body having a fuel and air mixing passage formed therein and an opening in fluid communication with the fuel and air mixing passage;

a fuel metering assembly carried by the body and including a fuel metering diaphragm that defines at least part of a fuel chamber that is communicated with the opening; and a groove formed in the body and open to the fuel chamber, said groove communicating at one end with the opening so that fluid in the groove is communicated with the fuel and air mixing passage and extending outwardly from the opening to an end spaced from the opening.

2. The carburetor of claim 1 wherein the body defines an upper wall of the fuel chamber and the groove is formed in the upper wall of the fuel chamber.

3. The carburetor of claim 1 wherein the groove extends to the opening.

4. The carburetor of claim 1 which also comprises a plurality of grooves each being formed in the body in communication with the fuel chamber and in communication with the opening.

5. The carburetor of claim 1 which also comprises a fuel jet carried by the body in the opening such that the fuel chamber is communicated with the fuel and air mixing passage through the fuel jet, and said groove is communicated with the fuel and air mixing passage through the fuel jet.

6. The carburetor of claim 1 wherein the opening is defined by a recess formed in the carburetor body.

7. The carburetor of claim 1 which also comprises a fuel nozzle carried by the body and having an orifice in communication with the fuel chamber and the fuel and air mixing passage so that fuel in the fuel chamber flows into the fuel and air mixing passage through the orifice, and the groove is communicated with the orifice so fluid in the groove flows into the fuel and air mixing passage through the orifice.

8. The carburetor of claim 1 wherein the body includes a cavity that defines part of the fuel chamber and wherein the groove extends outwardly beyond the periphery of the cavity.

9. The carburetor of claim 1 wherein the groove extends from the opening to a periphery of the fuel chamber.

10. The carburetor of claim 1 which also comprises a diaphragm that is carried by the body and defines part of the fuel chamber, and wherein the groove extends from the opening to a junction between the diaphragm and the body.

11. The carburetor of claim 1 wherein the groove has opposed ends and a length between its ends that is greater than a depth of the groove in the body.

12. A carburetor, comprising:

a body having a fuel and air mixing passage formed therein and an opening in fluid communication with the fuel and air mixing passage;

a fuel metering assembly carried by the body and including a fuel metering diaphragm that defines at least part of a fuel chamber that is communicated with the opening; and a plurality of grooves each being formed in the body in communication with the fuel chamber and in communication with the opening wherein at least two grooves are provided with each groove extending radially outwardly from the opening and being circumferentially spaced apart from each other.

13. A carburetor, comprising:

a body having a fuel and air mixing passage formed therein and an opening in fluid communication with the fuel and air mixing passage;

a fuel metering assembly carried by the body and including a fuel metering diaphragm that defines at least part of a fuel chamber that is communicated with the opening; and a groove formed in the body and open to the fuel chamber, said groove communicating at one end with the opening so that fluid in the groove is communicated with the fuel and air mixing passage wherein the groove extends from an outward end spaced from the opening to an end adjacent to the opening, with the outward end extending outwardly from the edge of the portion of the fuel chamber defined by the body.

14. A carburetor, comprising:

a body having a fuel and air mixing passage formed therein and an opening in fluid communication with the fuel and air mixing passage;

a fuel metering assembly carried by the body and including a fuel metering diaphragm that defines at least part of a fuel chamber that is communicated with the opening; and a groove formed in the body and open to the fuel chamber, said groove communicating at one end with the opening so that fluid in the groove is communicated with the fuel and air mixing passage wherein the fuel chamber is defined in part by a recess in the, body that has a narrowing wall and an upper wall and the groove is formed in at least a portion of both the narrowing wall and the upper wall.

15. The carburetor of claim 14 wherein the groove has a substantially constant depth in said narrowing wall.

16. The carburetor of claim 14 wherein the groove has a depth in the upper wall that is greater than the depth in the narrowing wall.

17. The carburetor of claim 16 wherein the depth of the groove in the upper wall increases as the groove extends from the narrowing wall to the opening.

* * * * *

UNITED STATES PATENT AND TRADEMARK OFFICE

CERTIFICATE OF CORRECTION

PATENT NO. : 7,097,162 B2
APPLICATION NO. : 10/810984
DATED : August 29, 2006
INVENTOR(S) : Tadaatsu Ichihara et al.

It is certified that error appears in the above-identified patent and that said Letters Patent is hereby corrected as shown below:

Column 6
Line 13, after "the" delete the comma ",".

Signed and Sealed this

Twenty-ninth Day of May, 2007

JON W. DUDAS
*Director of the United States Patent and Trademark Office*